US006648156B1

(12) United States Patent
Bryfors et al.

(10) Patent No.: US 6,648,156 B1
(45) Date of Patent: Nov. 18, 2003

(54) METHOD FOR HANDLING CONTAINERS AND A MEANS TO CARRY OUT A METHOD FOR SELECTING A DESIRED POSITION ON A STACKING TARGET

(75) Inventors: Uno Bryfors, Västerås (SE); Christer Johansson, Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/807,531

(22) PCT Filed: Oct. 14, 1999

(86) PCT No.: PCT/SE99/01851

§ 371 (c)(1),
(2), (4) Date: Jun. 13, 2001

(87) PCT Pub. No.: WO00/23347

PCT Pub. Date: Apr. 27, 2000

(30) Foreign Application Priority Data

Oct. 22, 1998 (SE) ..... 9803661

(51) Int. Cl.[7] ..... B66C 13/46
(52) U.S. Cl. ..... 212/270
(58) Field of Search ..... 212/270

(56) References Cited

U.S. PATENT DOCUMENTS 5,729,453 A * 3/1998 Lee et al. ..... 364/424.07
5,780,826 A 7/1998 Hareyama et al.
6,124,932 A * 9/2000 Tax et al. ..... 356/372
6,182,843 B1 * 2/2001 Tax et al. ..... 212/274

FOREIGN PATENT DOCUMENTS

| | | | |
|---|---|---|---|
| DE | 4423797 | * | 1/1996 |
| DE | 4427138 | * | 2/1996 |
| DE | 19519741 | * | 12/1996 |
| DE | 198 03 202 | | 7/1999 |
| EP | 820957 | * | 7/1997 |
| GB | 2221212 | * | 1/1990 |
| JP | 218217 | * | 1/1996 |
| WO | WO 92/19526 | | 11/1992 |
| WO | 94/05586 | * | 3/1994 |
| WO | WO 97/18153 | | 5/1997 |

* cited by examiner

*Primary Examiner*—Steven A. Bratlie
(74) *Attorney, Agent, or Firm*—Dykema Gossett PLLC

(57) ABSTRACT

A method for handling containers in which containers are stacked using a moveable crane with a travelling part such as a trolley (8) arranged to lift, move and land a container (7) on a stacking target (15) in a stack comprising a least one ground container (1). The method is characterised by the steps of measuring the horizontal position of the stacking target (15), determining the horizontal position of the ground container (1), and comparing the relative positions of stacking target (15) and ground container (1). An overlap is developed from the relative positions of the stacking target (15) and the ground container (1), and compared to predetermined limits. If the overlap is within limits a desired landing position (25) on the stacking target (15) is selected for the container (7). Advantages include automatic stacking, faster stacking, safer stacks and dense packing of stacks in a container terminal.

7 Claims, 7 Drawing Sheets

METHOD FOR HANDLING CONTAINERS AND A MEANS TO CARRY OUT A METHOD FOR SELECTING A DESIRED POSITION ON A STACKING TARGET

TECHNICAL FIELD

The present invention relates to a method for handling freight containers. In particular it is a method for determining a desired position on a given stacking target where a container should be placed.

BACKGROUND ART

A vast amount of freight is shipped in standard shipping containers. At each point of transfer from one transport means to another, for example in ports and harbours, there is a tremendous number of containers that must be unloaded, transferred to a temporary stack, and later loaded on to another ship or to another form of transport.

In a place for handling containers, such as a container terminal, containers are usually stacked in substantially rectangular groups of stacks. Containers are usually arranged with long axes ordered parallel in substantially parallel rows. The rows are laid out to provide a clearance between containers in each row, and with a clearance between each row of containers. Space in such container yards is at a premium and so the clearance between container rows and containers is required to be minimal and stacks consisting of typically 4–8 containers on top of each other have to be created. High density stacking is also necessary to avoid long transport distances within a container terminal.

The high running cost of ships requires that containers be moved between ship and stack as rapidly as possible so that a ship may be unloaded, loaded and turned around in the shortest possible time. To achieve the shortest unloading and loading times container handling equipment has to be partly and/or preferably completely automated in normal operation.

The technical demands of handling containers are great. The tare weight of containers is usually consistent, but the gross weight varies considerably. The width of shipping containers is standardised at 8 ft, but the height varies between from 8 and 9.5 ft. The most common standard lengths are 20 ft and 40 ft long. The 40 ft container is very common today and even longer containers up to 53 ft long are also in use. Thus the size of containers varies as well as the gross weight. The size of the part of a container that is load bearing, a corner casting, is the same size and area for all sizes of container. With the increase in average length of containers handled it becomes more difficult and more important to place containers accurately in a specified place, known as a stacking target, so as not to create unsafe stacking conditions in the container terminal.

A retrieval problem may occur when a stack of containers is placed so that it leans towards a lower stack of containers. A horizontal clearance is required for vertical access between two rows of containers. If the horizontal clearance between rows is insufficient, it may not be possible for an automatic lifting device either to sense or to access a container at the top of a lower stack.

A container may be handled by a crane, a crane moving on rails, a self-propelled container handling apparatus, or a lift or winch of any type all of which are referred to herein as a crane. Each crane has a lifting device usually incorporating a spreader of some kind that directly contacts a container, to grip it, lift it, lower it and release it. In this description the term spreader is used to denote a part of a lifting device that is in direct contact with a container. Spreaders are normally designed to handle more than one size of container, typically 20–40 ft or 20–40–45 ft long containers.

A problem of safe high density stacking of containers is to keep each stack of containers stacked on a ground slot within predefined limits of the ideal position of the ground slot and a sufficient, but minimum distance, away from other stacks. For safe operation it is also necessary to continuously verify that the criteria are met.

Insufficient horizontal clearance for access to a container on a stack can have more than one possible origin. The first container in the stack, the container in the ground slot, as the position on the ground is called, may have been incorrectly placed relative to an intended location. A container correctly located in a ground slot may subsequently have been moved, by accident for example. Also, one or more containers placed on top of a container in a ground slot may have been misplaced with respect to the container beneath it or later have been moved by accident or, for example, misplaced due to the effect of wind. It is also possible that another container or stack may be placed too close to a container or stack which is otherwise previously correctly positioned. Another factor is that the ground surface may not be sufficiently horizontal. An additional factor is that one or more containers in a stack may be damaged or of poor quality, such that upper and lower surfaces of the container are not parallel, causing a stack to lean.

Another problem is that of unstable stacks. Stacks that are, or become, unstable can have the same origins and factors as above, as well as a possibility that the overlap of the load bearing part of a containers structure may be too small. The load bearing part of a container is a corner casting fitted in each corner of a container. When containers are stacked on top of each other it is the corner castings that bear the load. If the overlap of the corner castings of containers stacked on each other is too small the stack may be unstable.

Within the general requirement of handling containers efficiently there exists a technical problem in determining accurately the correct position where a container should be stacked before it is realistically possible to land a container correctly on a predetermined position. It is also desirable to verify that the stack supporting the stacking target is safe to land a container on and that the correct position can be reached with a safe path that does not interfere with other containers.

It is known from SE 9401120-2 and JP 8 165 086 and some existing installations that attempts have been made to overcome part of the problems by mechanical means, for example, by equipping the container spreader with two so called stacking guides. The guides connect to the bottom of a container to be landed and guide it to line up with the top container beneath it.

The stacking guides however have many disadvantages including that they:

- add weight and cost to the spreader,
- include a lot of moving parts, sensors etc. which are subject to considerable forces during transfer of container, which makes the stacking guide a maintenance intensive equipment that also reduces the overall availability of the crane,
- the guides must have some clearance to the handled container resulting in a position error between the two containers. There is no means of controlling that this does not result in an accumulated error for a whole stack, require space outside the peripheral dimensions of the container itself, which adds to the space required between stacks and thereby reduces stacking density, a stacking guide can not assist in positioning the bottom container and can not correct for systematic errors caused either by ground conditions or containers not having parallel upper and lower surfaces, if the weight of the top container is low it may be displaced by the guides and, the operation of the stacking guide adds additional time to each landing of a container.

It is also known from GB 0656 868 to base an automatic landing of one container on another by the use of a sensing means to detect the relative position of an upper edge of the target container with respect to the lifting device/container to be landed. This method, however, does not provide any means for determining the ground position of the stack, the accuracy of the complete stack or for avoiding interference from adjacent stacks.

In addition to horizontal errors of placement in a direction parallel with or perpendicular to the line of the row and the long axis of a container when placing a container on a stacking target, a container may also be skewed. A skew is defined here as an angular displacement of the long axis of the container with respect to the line of the row.

In the unpublished Swedish patent application 9803341-8 a system describes one method to determine the precise horizontal location of a ground slot for a container. The system includes the use of one or more horizontal reference markers fixed to the ground adjacent to, and a predetermined distance away from, a ground slot. The horizontal reference markers are designed such that they may be detected by sensors on a travelling part of a moveable crane, and the distance between the crane and horizontal reference marker measured by the sensors. In this way, the horizontal position of a ground slot relative to a travelling part of a crane may be accurately measured and the distance to ground slot, or a container in a ground slot thereby determined.

However determining the position of a stacking target as a surface on top of a container, requires in addition, measurements of the vertical position of the top surface. For a safe stack, information is also required about the relative positions of containers in the stack. In the case where the stacking target is a surface on top of a container which is supported by one or more containers, the horizontal position of that stacking target is also required.

SUMMARY OF THE INVENTION

It is an object of the invention to provide a method to determine a position for landing a container on a stacking target based on measurement of the horizontal and vertical position of the stacking target as well as a determined position of a ground container in a stack. It is another object of the invention to determine if a vertical envelope of a stacking target is within predetermined limits and represents a safe stacking target. It is another object of the invention to provide a method to determine a desired position on a stacking target relative to the position of the stacking target and the ground container. It is another object of the invention to determine a safe path to the stacking target. It is another object of the invention to determine a safe distance between the stacking target and one or more containers in one or more stacks adjacent to a stacking target. It is another object of the invention to measure the position of a container after landing on a stacking target and thus verify correct placement.

These and other objects are realised by a method according to the invention. The present invention is a method for determining a desired position on a stacking target for a container based on measuring the position of the stacking target and the ground container in the stack.

The main advantage of the present invention is that a container may be landed in a position on a stacking target that ensures sufficient overlap on each of the 4 corner casting to the container below and that it is landed as close to the horizontal position of the ground container as possible, eliminating any accumulated errors.

Another advantage is that a container may be landed on a desired position on a container comprising a stacking target. A stacking target may be any surface such the top surface of a container stacked in a ground slot, or the top surface of the top container of a stack of two or more containers stacked on a ground slot. A ground slot is used here to describe a stacking target on any substantially horizontal surface such as the ground, a support surface constructed on the ground, a ships deck, a deck or floor inside a building or the loading surface of a vehicle. When containers are stacked on top of each other, it is only the corner castings located in each corner of a container that are load bearing, so it is important that stacked containers overlap each other as closely as possible.

The invention also assures that a container may not be automatically landed on a stack unless it is within predefined limits to the ground container. The invention also ensures that attempts to land automatically are not made if any container in any of the adjacent stacks is interfering with stipulated margins around the path of the container to the determined landing position The benefits of the present invention include that a container placed on desired position on a stacking target overlaps not only the supporting container making up the stacking target, but also overlaps the ground container or is placed in a mid-position of best overlap between the stacking target and the ground container in the same stack. This means that any error or displacement in the overlap of containers placed one on top of the other in the stack is diminished rather than accumulated. This in turn means more accurately stacked stacks, which permits stacks of containers to be densely packed with respect to each other. The method provides that the total deviation of the stack will not be more than 2 times the positioning accuracy of the crane, and may in practice be better than that.

Another advantage of more accurately stacked stacks is that a safe working distance between stacks is more easy to attain and maintain in practice. This ensures that there is sufficient clearance between adjacent stacks of containers so that containers may be handled efficiently and without damage to containers.

Another advantage is that a container may be automatically lowered into a precisely measured target position. This offers the important economic benefit of rapid handling of containers, which is extremely important in maintaining low and competitive freight costs. Another advantage with an economic benefit is that clearances between stacks and rows may be kept to a minimum, reducing the area of ground needed for storing containers.

The present invention is not limited by direction of approach of a crane towards a ground slot, stacks of differing heights or by containers of differing lengths. The present invention is very useful in facilitating trade by making container handling fast and keeping costs low. It is also not restricted to shipping ports and may be applied to handling any containerised freight, such as air freight, and containers on and off trains or trucks.

BRIEF DESCRIPTION OF THE DRAWINGS

The present invention will be described in more detail in connection with the enclosed schematic drawings.

DESCRIPTION OF THE PREFERRED EMBODIMENTS

FIGS. 1–4 include equipment that is part of the prior art.

Figure 1:
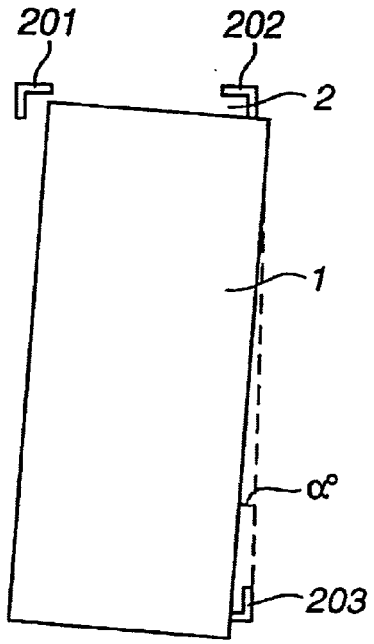
Fig. 1 (PRIOR ART)
FIG. 1 shows a top view of container horizontally mis-aligned in a ground slot.

FIG. 1 shows a top view of a container 1 mis-aligned in a ground slot 2. Ground slot 2 is indicated by four corner marks painted on the ground, of which only three, 201, 202, 203 are visible in the figure. Container 1 is shown here skewed by an angle $\alpha$ relative to the long axis of the ground slot 2.

Figure 2:
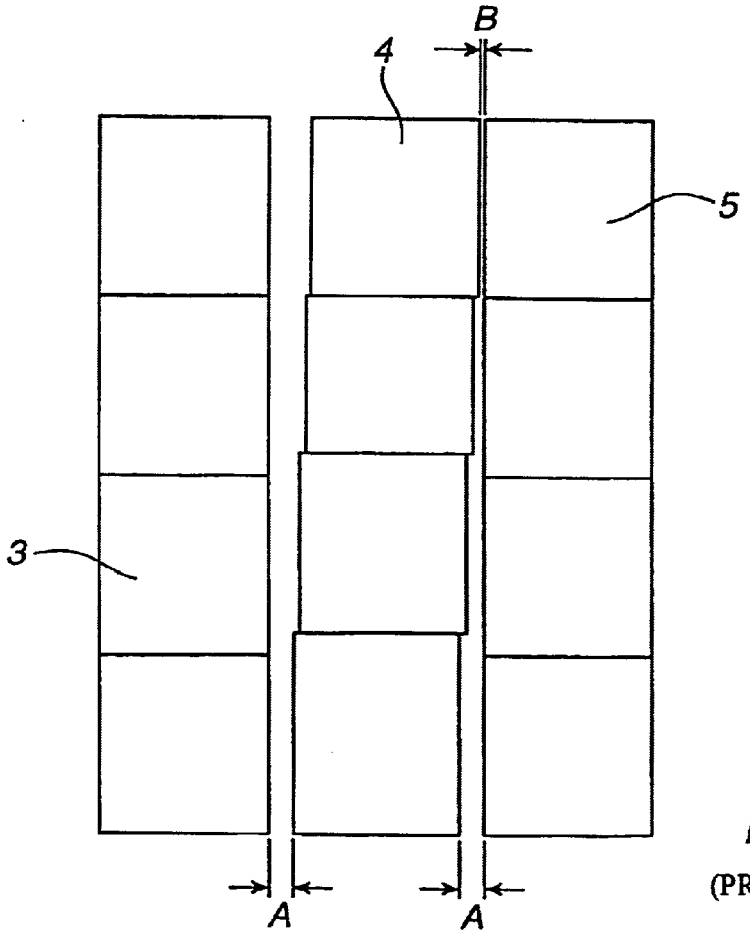
Fig. 2 (PRIOR ART)
FIG. 2 shows an end view of a stack of containers with accumulated mis-alignments.

FIG. 2 shows a side view of the ends of first container stack 3, a second container stack 4 and a third container stack 5. Stacks 3, 4, 5 are each separated by distance A at ground level. Stack 4 shows an accumulated stacking error so that the horizontal distance between the top containers of stacks 4, 5 is reduced to a distance B.

Figure 3:
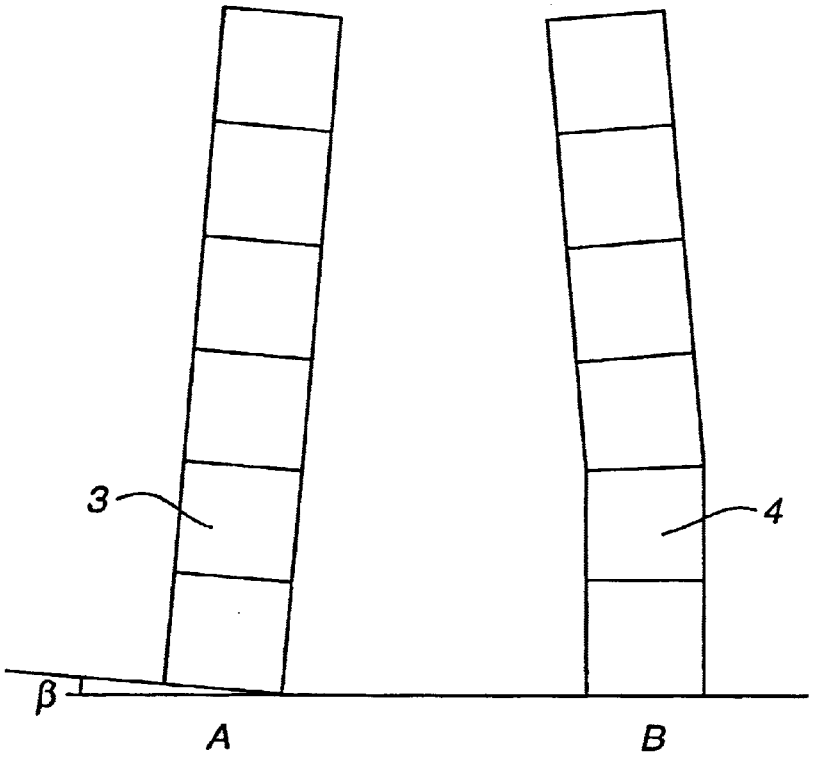
Fig. 3 (PRIOR ART)
FIG. 3 shows an end view of two stacks of containers out of alignment.

FIG. 3 shows a side view of a container stack 3 on a surface that is inclined at an angle $\beta$ to the horizontal. A second container stack 4 is shown to include one or more containers with damaged or non parallel support surfaces.

Figure 4:
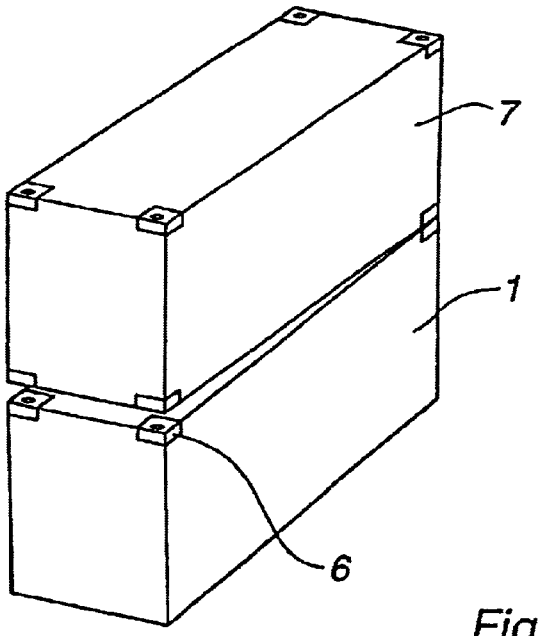
Fig. 4 (PRIOR ART)
FIG. 4 shows a perspective view of two containers with corner castings indicated.

FIG. 4 shows the position of corner castings 6 in the top surface of a ground container 1 supporting a second container 7 placed on top of it. The corner castings 6 are the only load bearing surfaces in a standard freight container that are capable of bearing the weight of one or more containers. Containers must be placed on top of each other sufficiently aligned such that the corner castings 6 of each container such as container 7 are supported by the corner castings 6 of a supporting container such as ground container 1.

Figure 5:
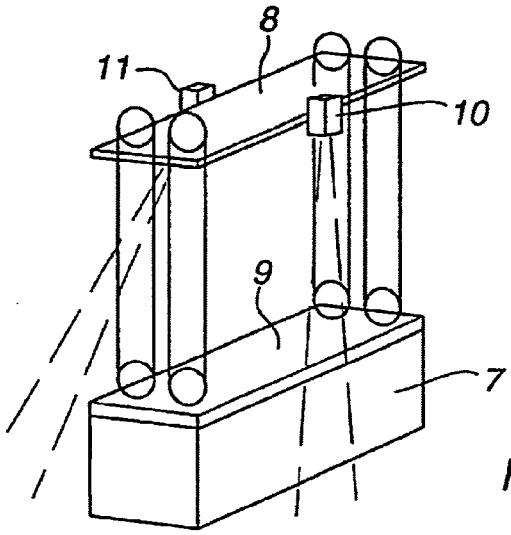
FIG. 5 shows a travelling part of a crane arranged with sensors and holding a container.

FIG. 5 shows a container 7 held by a travelling part of a crane, comprising a trolley 8 and a spreader 9. The spreader 9 is suspended by cables below trolley 8 such that spreader 9 with the container 7 may be raised or lowered under trolley 8. The trolley 8 is arranged according to the present invention with sensor means, preferably 2-dimensional or 3-dimensional laser scanners, hereafter described as 2-D or 3-D scanners. In the embodiment shown, two 3-D scanners 10, 11 are mounted substantially centrally on the trolley 8 looking down from either side of trolley 8.

Figure 6:
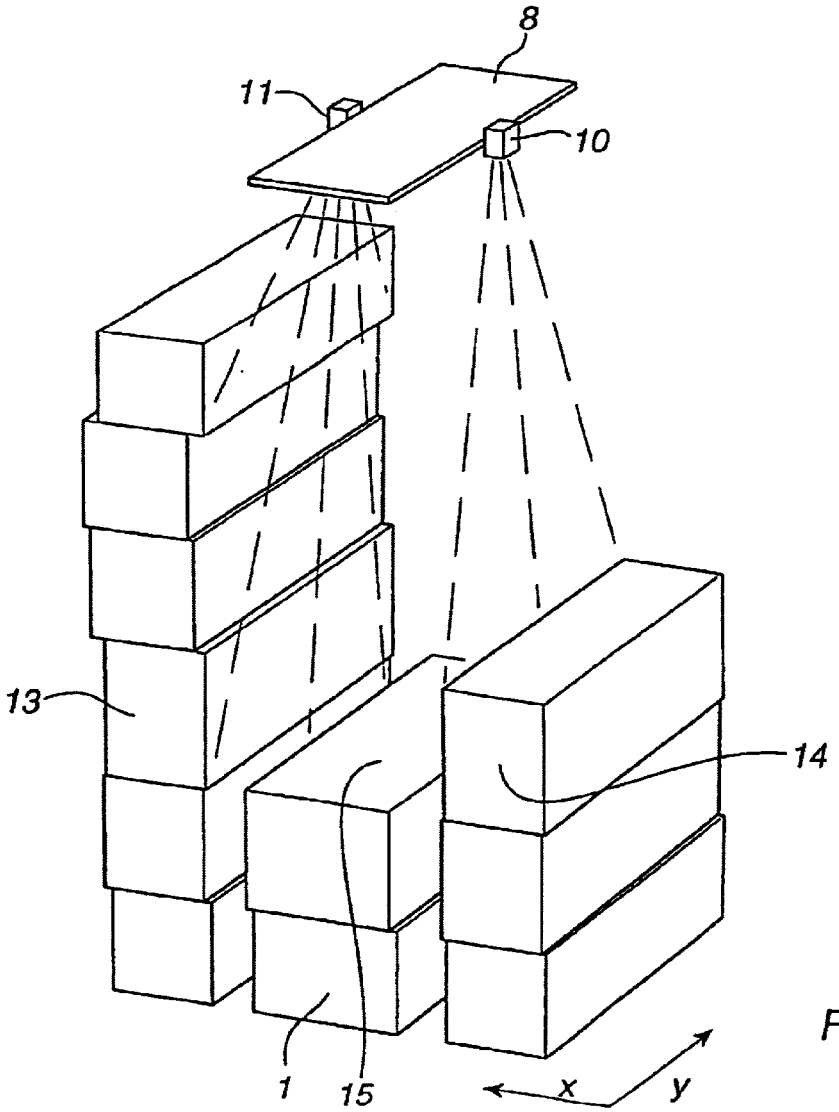
FIG. 6 shows a travelling part of a crane arranged with sensors substantially above a stacking target.

According to the invention, container 7 held as shown in FIG. 5 is moved toward a selected stacking target 15, which may be adjacent to other stacks of containers as shown in FIG. 6. A stacking target may be any surface such as a top surface of a container stacked in a ground slot, or the top surface of the top container of a stack that may be up to seven or eight containers high. Stacking target 15 is shown for example in FIG. 6 as the top surface of a container of a stack two containers high. Measuring means, preferably 3-D scanners 10, 11 arranged on the trolley 8 detect the sides of containers in adjacent stacks. In FIG. 6 container 7 and spreader 9 under trolley 8 have been omitted from the drawing for the sake of visual simplicity.

Figure 7:
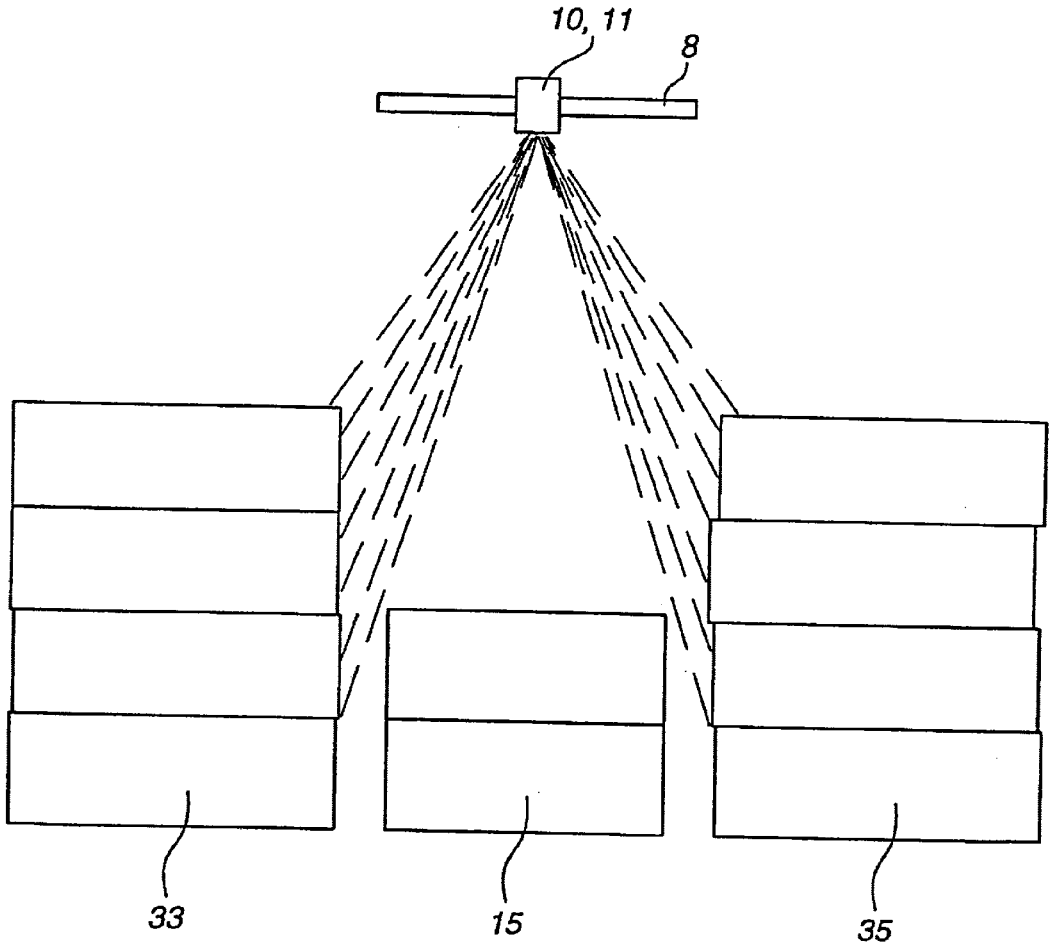
FIG. 7 shows a travelling part of a crane arranged with sensors to detect and measure position of the ends of containers in a stacking target and adjacent stacks.

Considering FIGS. 5 and 6, 3-D scanners 10, 11, on trolley 8 scan the sides, in several positions as indicated in FIG. 6, of containers in adjacent rows 13, 14 detect the containers in those stacks, and measure the distance of each container in each stack from the trolley 8. FIG. 7 shows measurements also being taken between the ends of stacks in a row of stacks 33, 35, and 15. A measurement is made of the distance between each container detected in a stack and the travelling part of the crane, trolley 8, so that the horizontal distance to each container in the stack is known. Thus for a stack such as 13 in FIG. 6, the distances to each container in that stack result in horizontal measurements. The measurements for each detected adjacent stack are stored in a memory means, for example connected to a control unit of the crane. In particular, measurements of the position of the closest containers of the adjacent stacks 13, 14, 33, 35 to the stacking target 15 are stored.

Figure 10:
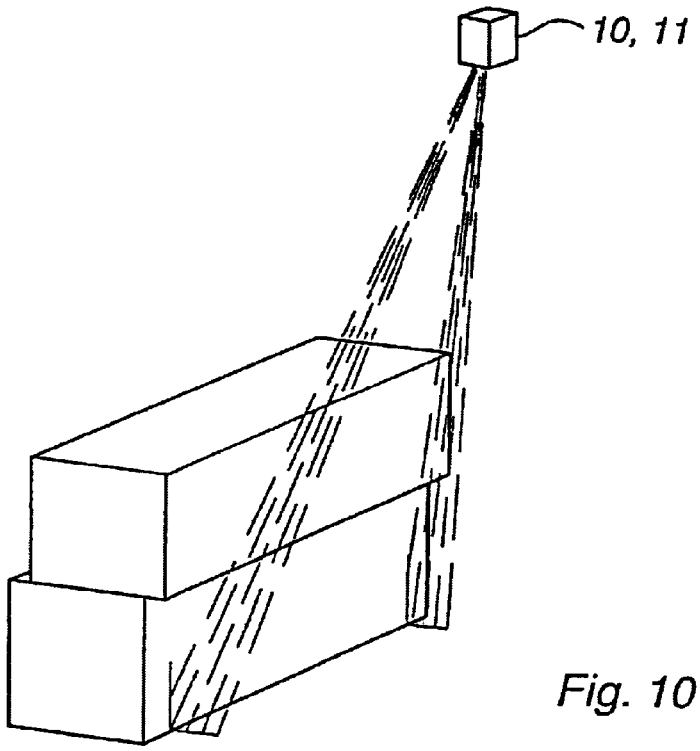
FIG. 10 shows a sensor relative to a ground container of a stack in which two containers are stacked out of alignment.

The horizontal position of the ground container 1 of the stack comprising the stacking target is determined. The horizontal position of ground container 1 in the x-direction and for skew is measured as shown in FIG. 10 using 3-D scanners 10, 11 mounted on a travelling part of the crane such as trolley 8. The y-direction may be measured by an additional sensor means arranged at the ends of the trolley 8 or may be estimated from an ideal position in a ground slot.

Figure 9:
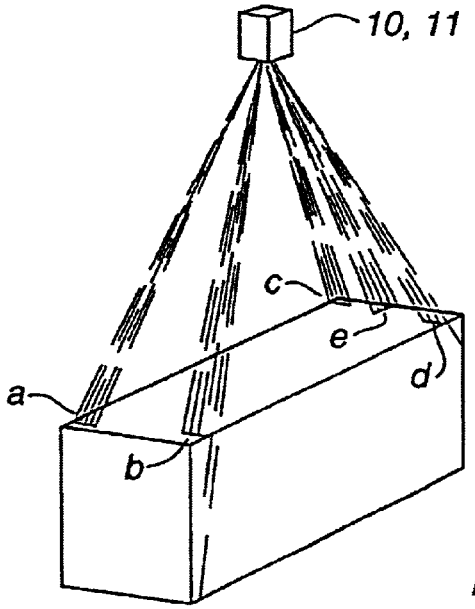
FIG. 9 shows a sensor relative to corners, corner castings and other parts of a container forming a stacking target.

The position of the top container comprising the stacking target is measured as shown in FIG. 9 using 3-D scanners 10, 11. Measurements such as a or b together with c or d may be taken to measure the alignment, and in particular to measure the skew of the long axis of a container.

When the horizontal position has been measured for the stacking target 15 and a horizontal position determined for the ground container 1 the two positions are compared using a control unit of the crane. A relative overlap of the stacking target 15 with respect to the position of the ground container 1 is examined and compared to predetermined limits. If the overlap is within limits a landing may proceed, and so a desired position on the stacking target will then be determined.

Figure 8:
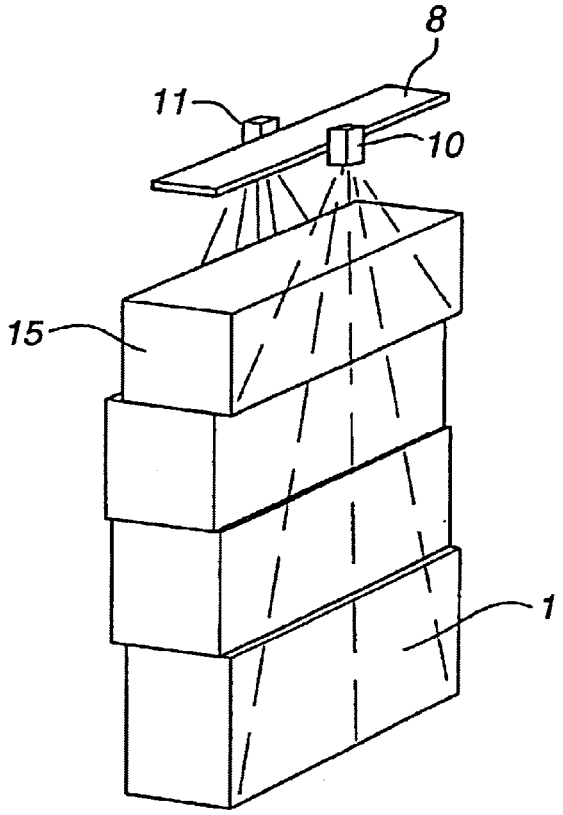
FIG. 8 shows an end view of stacks of containers indicating measurements for a vertical envelope of the stacking target.

A vertical stacking envelope for a stacking target, consisting of an envelope projected up from the ground container to the top of the stack and above, is generated from measurements by 3-D scanners 10, 11 indicated in FIG. 8. The dimensions of the vertical stacking envelope in a horizontal plane include the maximum horizontal displacement found for all containers in the stack. The vertical envelope for the stacking target 15 is compared to the distances measured and stored to containers in adjacent stacks. If the horizontal distance between the vertical stacking envelope of the stacking target 15 and the nearest adjacent stack 13, 14 is greater than a predetermined safe distance, a safe vertical stacking envelope is identified and the process of determining a landing position continues. The maximum horizontal displacement measured of any container in the stack of the stacking target 15 is also evaluated against the limits relative to the ideal ground slot position.

It should be noted that the horizontal position of the ground container may be determined by more than one method within the scope of the claims. The position may be directly measured using sensor means 10, 11 on the trolley 8 shown in FIG. 10 and as detailed above. The horizontal position may also be determined using the position of one or more horizontal reference markers (17, 18). The horizontal position may alternatively be found from stored information, estimated from stored information about an ideal position of a ground slot, or generated from a combination of these methods.

Figure 12:
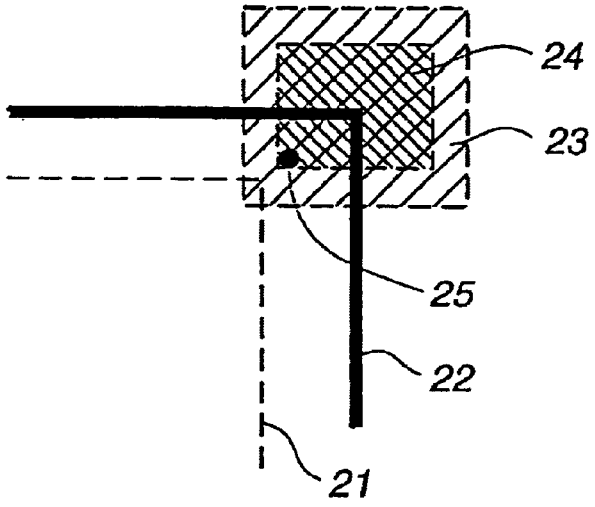
FIG. 12 shows a position of the corner casting of one container in a stack relative to a corner casting of the ground container.

In a further development of the invention a desired position on the stacking target may be selected so as to offset existing stacking errors in the stack. FIG. 12 shows a representation of a first corner 22 of the top container of stacking target 15 and a second corner 21 of a container lower down in the same stack, preferably the ground container 1. FIG. 12 also shows an area 23 within which the corner of the container 7 to be landed must be positioned in order to provide a minimum desirable overlap corresponding to a rectangular area smaller than the area of a top or bottom face of a corner casting. A smaller area 24 is calculated by a calculating means connected to a control unit of the crane, based on the specified accuracy of the crane position measurement and automation systems. A point 25, the desired landing position, is identified as the position within area 24 which gives the minimum displacement relative to the ground container. Point 25 is the desired landing position where the corner of a container 7 to be landed should be placed. Thus a desired landing position 25 is generated on the stacking target, which position is characterised in that the container 7 overlaps the lower or ground container 1 as well as the top container immediately supporting container 7 to be landed, thus ensuring that the stack remains vertically straight, and that successive errors are not accumulated.

The desired landing position 25 and the corresponding target points for the other corners are used to calculate reference positions for the crane automation systems.

Figure 11:
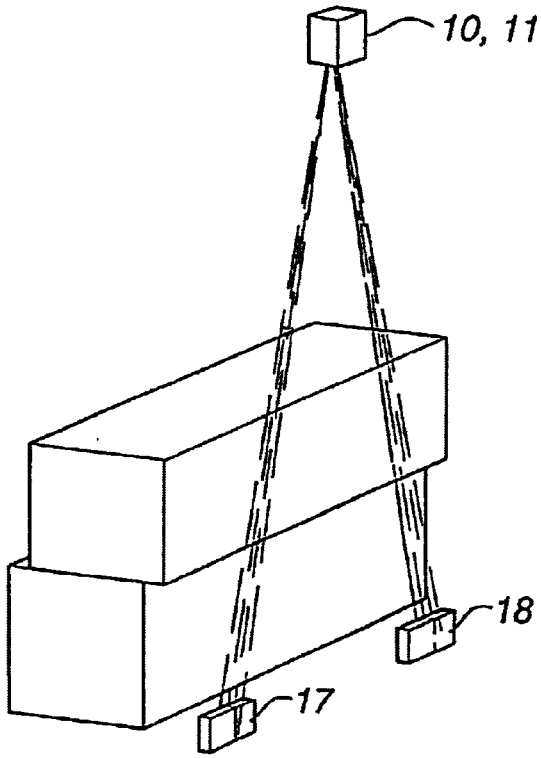
FIG. 11 shows the preferred embodiment with sensor relative to a container in a ground slot and two horizontal reference markers.
Figure 13:
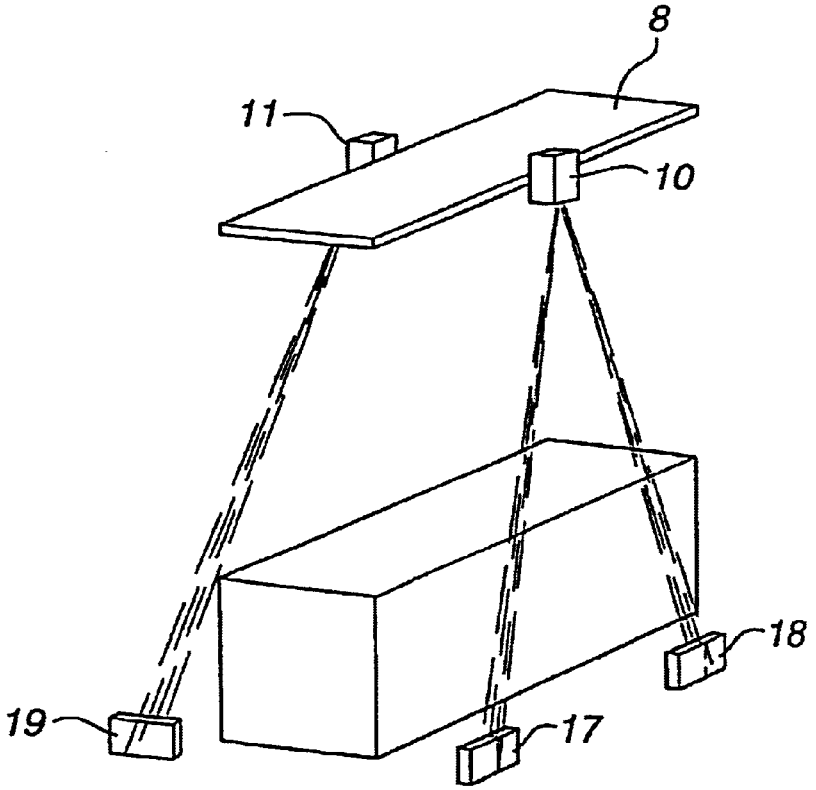
FIG. 13 shows a development of the preferred embodiment with a sensor relative to a container in a ground slot and horizontal reference markers.

In the preferred embodiment of the invention the position of the ground container 1 is found by measuring a distance from the travelling part such as trolley 8 with 3-D scanners 10, 11 to one or more horizontal reference markers (17, 18) such as those described in the unpublished Swedish patent application 9803341-8. The horizontal reference markers (17, 18) are in placed for that purpose adjacent to, and a pre-determined distance from, a ground slot in which ground container 1 is situated as shown in FIG. 11. A horizontal reference marker (19) may also be placed as shown in FIG. 13 in relation to one or both ends of a ground slot such that the position of the ground slot in the y-direction may be sensed by a 3-D scanner 10 or 11 to measure the full x, y position of the ground container 1 including skew.

In a further development of the invention an additional procedure is carried out. Once landing of the container is verified by, for example, appropriate pressure sensors or load sensors arranged on a travelling part of the crane, the position of the container 7 as landed is measured using 3-D scanners 10, 11 arranged on the trolley 8. The measurements are compared to the desired landing position 25 and identified by a control process within a control unit of the crane as being inside or outside a predetermined tolerance. A signal is generated indicating that landing is satisfactory or that the landing is not satisfactory and must be repeated.

What is claimed is:

1. A method for handling containers in which containers are stacked using a moveable crane with a traveling trolley arranged to lift a container, by moving, lifting and landing said container on a stacking target in a stack including at least one ground container, comprising the steps of:

measuring the horizontal position of the stacking target, said stacking target being the top surface of the uppermost container of the stack, determining the horizontal position of the ground container, comparing the relative positions of said stacking target and said ground container, determining an overlap from the relative positions of said stacking target and said ground container, and determining if the overlap is within predetermined limits, and if so, determining a desired landing position for the container on the stacking target, said landing position being so selected to offset possible stacking errors in the stack.

2. A method according to claim 1, in which the container is landed next to an adjacent stack of containers, further comprising: measuring a horizontal distance between the trolley and each container in the stacking target, calculating a horizontal displacement for each container in the stacking target and generating a vertical envelope for the stacking target, said vertical envelope being a projection from the ground container up to the top of the stack and above, measuring a horizontal distance between the trolley and each container in said adjacent stack of containers, determining the minimum distance between the vertical envelope of the stacking target and any container in said adjacent stack of containers, and establishing that a safe minimum distance between the stacking target and said adjacent stack of containers exists.

3. A method according to claim 1, further comprising: measuring a first vertical and horizontal position of the top surface of a top container of the stacking target and storing the measurement in control unit memory means, measuring a second position of at least the ground container in the stack and storing the measurement in control means memory, comparing the first position for the top container of the stacking target and the second position for the ground container, and selecting a desirable landing position point such that the corner casting of a container placed on point on the stacking target overlaps a corner casting of the container on the ground as well as a corner casting of the top container of the stacking target.

4. A method according to claim 1, further comprising: measuring the position of one or more horizontal reference markers placed adjacent to and a predetermined distance from the stacking target, and calculating the horizontal position of a ground container of the stacking target based on the predetermined distance between said one or more horizontal reference markers and the ground container of the stacking target.

5. A method according to claim 1, further comprising the steps of:

detecting each container in an adjacent stack, measuring the horizontal distance from the trolley to each container and storing the measurements in control means memory, measuring the position of the nearest container in said adjacent stack relative to the stacking target, comparing the vertical stacking envelope to predetermined safe tolerances stored in control means memory, and determining if the vertical stacking envelope is within safe tolerances.

6. A method according to claim 1, further comprising: detecting a completed landing of said container on the stacking target, measuring the position of said landed container, comparing the position of said landed container with the selected desired position of the stacking target, determining the landed position to be within acceptable predetermined tolerances and if so, and generating a signal showing the landing to be acceptable.

7. Apparatus to carry out a method for handling containers in which containers are stacked using a moveable crane with a traveling trolley arranged to lift a container, by moving, lifting and landing said container on a stacking target in a stack including at least one ground container, said method comprising the steps of: measuring the horizontal position of the stacking target, said stacking target being the top surface of the uppermost container of the stack, determining the horizontal position of the ground container, comparing the relative positions of said stacking target and said ground container, determining an overlap from the relative positions of said stacking target and said ground container, and determining if the overlap is within predetermined limits, and if so, determining a desired landing position for the container on the stacking target, said landing position being so selected to offset possible stacking errors in the stack, said apparatus comprising:

a moveable crane, control means for the crane including a memory means, the trolley including a laser sensor means, said trolley arranged with a spreader for holding said container such that horizontal measurements made by said sensor means of distances from said trolley to the stacking target and horizontal measurements of distances from said trolley to the ground container being stored in the memory means to calculate said desired position.

* * * * *